US012624847B2

(12) United States Patent
Hughes et al.

(10) Patent No.: US 12,624,847 B2
(45) Date of Patent: May 12, 2026

(54) HUMIDIFIER WET-PACK ASSEMBLY

(71) Applicant: RESEARCH PRODUCTS CORPORATION, Madison, WI (US)

(72) Inventors: Nathan Adam Hughes, Madison, WI (US); Steven Howard Farra, Madison, WI (US); Ryan Alexander Kitching, Madison, WI (US); Joshua Edwards McKune, Madison, WI (US); Michael Jonathon Schatz, Madison, WI (US)

(73) Assignee: Research Products Corporation, Madison, WI (US)

( * ) Notice: Subject to any disclaimer, the term of this patent is extended or adjusted under 35 U.S.C. 154(b) by 331 days.

(21) Appl. No.: 18/404,165

(22) Filed: Jan. 4, 2024

(65) Prior Publication Data

US 2024/0219046 A1 Jul. 4, 2024

Related U.S. Application Data

(60) Provisional application No. 63/437,015, filed on Jan. 4, 2023.

(51) Int. Cl.
*F24F 6/04* (2006.01)
*F24F 6/00* (2006.01)

(52) U.S. Cl.
CPC ..... *F24F 6/04* (2013.01); *F24F 2006/006* (2013.01); *F24F 2006/046* (2013.01)

(58) Field of Classification Search
CPC ... F24F 6/04; F24F 2006/006; F24F 2006/046
USPC ..... 261/106
See application file for complete search history.

(56) References Cited

U.S. PATENT DOCUMENTS

| | | | |
|---|---|---|---|
| 2,947,452 | A | 8/1960 | Frohmader et al. |
| 2,948,233 | A | 8/1960 | Scharfe |
| 3,058,726 | A | 10/1962 | Goettl |
| 3,265,371 | A | 8/1966 | Mcgrath |

(Continued)

FOREIGN PATENT DOCUMENTS

| | | |
|---|---|---|
| CN | 107328020 | 11/2017 |
| CN | 213237809 | 5/2021 |

(Continued)

OTHER PUBLICATIONS

AprilAire HYDRLH Hard Water Maintenance Kit for 720 Series Humidifiers. By Amazon.com. Dated Oct. 14, 2024. Found online [Mar. 25, 2025] https://www.amazon.com/AprilAire-HYDRLH-Maintenance-Humidifiers-ReplacemenUdp/BODK2HQ41V (Year: 2024).

(Continued)

*Primary Examiner* — Charles S Bushey
(74) *Attorney, Agent, or Firm* — Foley & Lardner LLP

(57) ABSTRACT

A wet-pack assembly includes a water panel, a scale control configured to surround the water panel on at least three sides, and a distribution tray disposed on a top portion of the water panel and coupled to the scale control via one or more joints. The one or more joints prevent separation of the distribution tray from the scale control. The wet-pack assembly also includes a feed tube extending from a basin formed within the scale control to the distribution tray, where the feed tube is structured to direct water flow from the basin to the distribution tray for recirculation to the water panel.

20 Claims, 14 Drawing Sheets

(56) References Cited

U.S. PATENT DOCUMENTS

| | | | | |
|---|---|---|---|---|
| 3,464,400 | A | 9/1969 | Wellman | |
| 3,464,401 | A | 9/1969 | Mcgrath | |
| 3,823,926 | A * | 7/1974 | Bracich | F24F 6/04 55/504 |
| 5,211,891 | A | 5/1993 | Anoszko | |
| 5,718,847 | A | 2/1998 | Koble | |
| 5,765,544 | A | 6/1998 | Vigansky | |
| 5,851,444 | A | 12/1998 | Hansell et al. | |
| 5,853,625 | A | 12/1998 | Kensok et al. | |
| 5,919,533 | A | 7/1999 | Smith et al. | |
| 5,932,148 | A | 8/1999 | Hansell et al. | |
| 5,948,324 | A | 9/1999 | Cook | |
| 5,971,366 | A | 10/1999 | Smith | |
| D416,994 | S | 11/1999 | Kensok et al. | |
| 6,394,427 | B1 | 5/2002 | Guetersloh et al. | |
| D468,798 | S | 1/2003 | Wilder | |
| 6,572,085 | B2 * | 6/2003 | Bloemer | F24F 6/04 261/106 |
| 7,950,631 | B2 | 5/2011 | Vasudevan et al. | |
| 8,096,534 | B2 | 1/2012 | Vasudevan et al. | |
| 8,794,603 | B2 * | 8/2014 | Quam | F24F 11/0008 261/106 |
| D752,178 | S | 3/2016 | Mjelde | |
| D967,383 | S | 10/2022 | Campbell et al. | |
| D1,027,155 | S | 5/2024 | Campbell et al. | |
| D1,040,987 | S | 9/2024 | Campbell et al. | |
| 2002/0171158 | A1 | 11/2002 | Bloemer | |
| 2006/0208369 | A1 | 9/2006 | Hayden | |
| 2008/0018001 | A1 | 1/2008 | Kammerzell et al. | |
| 2009/0102073 | A1 | 4/2009 | Vasudevan et al. | |
| 2011/0068491 | A1 | 3/2011 | Wang et al. | |
| 2011/0193246 | A1 | 8/2011 | Vasudevan et al. | |
| 2023/0213221 | A1 | 7/2023 | Hughes et al. | |
| 2023/0392803 | A1 | 12/2023 | Schatz et al. | |
| 2024/0219046 | A1 | 7/2024 | Hughes et al. | |

FOREIGN PATENT DOCUMENTS

| | | |
|---|---|---|
| WO | WO-00/10695 | 3/2000 |
| WO | WO-2018/227000 | 12/2018 |

OTHER PUBLICATIONS

Honeywell Frame and Tray Assembly for HE200 He 250. By Supplyhouse.com. Dated Feb. 24, 2024. Found online [Mar. 25, 2025] https://web.archive.org/web/20240224004839/https://www.supplyhouse.com/Honeywell-Home-50041861-002- Frame-and-Tray-Assembly-for-HE200-H E250 (Year: 2024).

* cited by examiner

HUMIDIFIER WET-PACK ASSEMBLY

CROSS-REFERENCE TO RELATED APPLICATIONS

This application claims priority to U.S. Provisional Patent Application No. 63/437,015, filed Jan. 4, 2023, the entirety of which is herein incorporated by reference.

BACKGROUND

The present disclosure relates generally to humidifying systems for increasing humidity of ambient air. More specifically, the present disclosure relates to a unitary wet-pack design for a humidifier to reduce risk of leakage, misalignment and component shift during maintenance (e.g., installation, replacement, cleaning, etc.) and/or use.

SUMMARY

One aspect of the present disclosure relates to a wet-pack assembly. The wet-pack assembly includes a water panel, a scale control configured to surround the water panel on at least three sides, and a distribution tray disposed on a top portion of the water panel and coupled to the scale control via one or more joints. The one or more joints prevent separation of the distribution tray from the scale control. The wet-pack assembly further includes a feed tube extending from a basin formed within the scale control to the distribution tray, where the feed tube is structured to direct water flow from the basin to the distribution tray for recirculation to the water panel.

In various embodiments, the feed tube includes a first portion and a second portion, where the first portion is coupled to an eductor outlet disposed within the basin. In some embodiments, the second portion is coupled to a flow divider disposed within the distribution tray. In other embodiments, the first portion extends from the eductor outlet and through an aperture disposed within the distribution tray. In yet other embodiments, the distribution tray includes a plurality of channels, where an end of each of the plurality of channels extends into the water panel. In various embodiments, the end of each of the plurality of channels extends into a corresponding recess disposed within the water panel. In some embodiments, the scale control includes an upper portion, where the upper portion is disposed adjacent the distribution tray and includes a ridge, and where a wall of the distribution tray is structured to be retained within the ridge. In other embodiments, the wall of the distribution tray is press-fit within the ridge. In yet other embodiments, the one or more joints includes heat stakes. In some embodiments, the one or more joints includes welds.

Another aspect of the present disclosure relates to a humidifier. The humidifier includes a wet-pack assembly and a valve and drain assembly fluidly coupled to the wet-pack assembly. The wet-pack assembly includes a water panel, a scale control configured to enclose the water panel, and a distribution tray disposed on a top portion of the water panel and coupled to the scale control, where the distribution tray is inseparable from the scale control. The wet-pack assembly also includes a feed tube extending from a basin formed within the scale control to the distribution tray, where the feed tube is structured to direct water flow from the basin to the distribution tray for recirculation to the water panel.

In various embodiments, the humidifier also includes a base, where the wet-pack assembly is structured to be received within the base such that the distribution tray is configured to couple to a surface of the base. In some embodiments, a surface of the distribution tray includes a snap feature, where the snap feature is structured to be received within a slot disposed within the surface of the base. In other embodiments, the surface of the distribution tray further includes a first protrusion and a second protrusion, where the snap feature is disposed between the first protrusion and the second protrusion. In yet other embodiments, the surface of the base further includes a first placement feature and a second placement feature, where the slot is disposed between the first placement feature and the second placement feature, and where the first protrusion is configured to be received within the first placement feature and the second protrusion is configured to be received within the second placement feature. In various embodiments, the scale control is configured to mount to the valve and drain assembly such that the scale control is selectively separable from the valve and drain assembly. In some embodiments, a bottom side of the scale control includes a dovetail protrusion, where the dovetail protrusion is configured to be received within a pocket formed in a housing of the valve and drain assembly to couple the valve and drain assembly to the wet-pack assembly. In other embodiments, at least a portion of the dovetail protrusion includes beveled edges. In yet other embodiments, the pocket includes a first wall and a second wall, where a thickness of at least one of the first wall or the second wall varies from a base of the pocket to an upper edge of the pocket. In various embodiments, the distribution tray includes an air seal extending downward from an outer wall of the distribution tray, where the air seal is configured to surround an upper portion of the water panel.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Generally, the present disclosure relates to a wet-pack assembly for a humidifier system, where the wet-pack assembly is designed to be serviced and replaced as a unitary assembly. Such a unitary assembly ensures that components that are critical to the performance and efficiency of the humidifier system are serviced simultaneously at necessary intervals. As the humidifier system operates, scale can build up within the system and lead to blockage of eductor intake and drain ports, which may cause loss of efficiency and performance. Scale buildup may also degrade performance of the humidifier system by clogging the water panel, restricting water flow in water flow conduits (e.g., feed tube), and causing uneven distribution of water by the distribution tray. Traditionally, service includes replacing the water panel and cleaning various internal components of scale. However, individually servicing wet-pack components may lead to misalignments and/or wear of joints (or mating components), which can increase risk of water leakage and decrease efficiency of the humidifier system. A unitary design of the wet-pack not only reduces time and labor necessary to service the humidifier system by capturing all critical components in a single cartridge, the design also reduces risk of misalignments and risk of water leakage.

Figure 1:
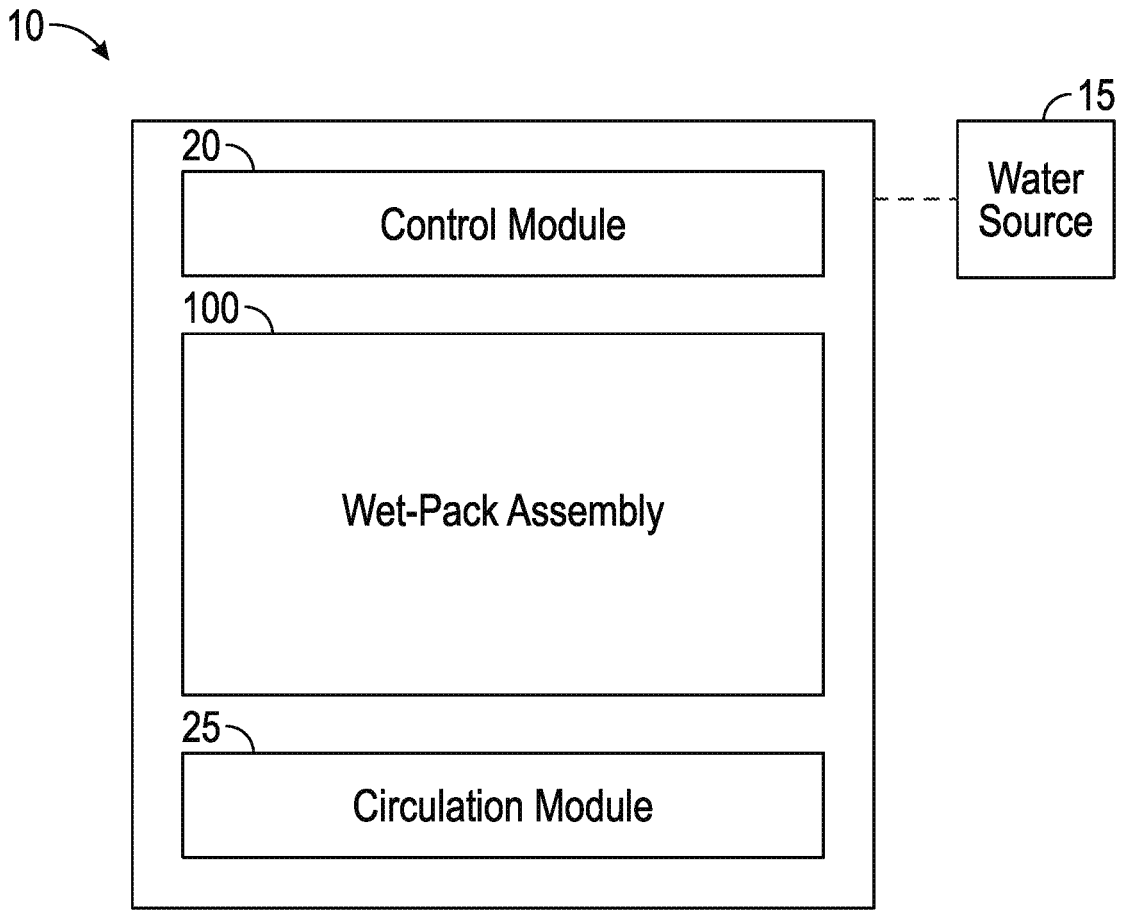
FIG. 1 is a schematic representation of a humidifier system, according to an exemplary embodiment.

Referring to FIG. 1, a humidifier system 10 is shown, according to an exemplary embodiment. The humidifier system 10 is configured to increase an amount of humidity within a space (e.g., building, room, home, etc.). In various embodiments, the humidifier system 10 may be a standalone system that may be disposed within a particular space to increase humidity therein. In other embodiments, the humidifier system 10 may be coupled to or included within a heating, ventilation, and air conditioning (HVAC) system. As shown, the humidifier system 10 includes or is coupled to a water source 15 (e.g., water supply to a structure, building, house, etc.). The humidifier system 10 also includes a control module 20, which may include or be communicatively coupled to one or more sensors configured to sense the humidity within a space. The control module 20 may also include one or more controllers, which are in communication with the one or more sensors and are configured to control operation of the humidifying system 10 based on one or more signals received from the one or more sensors. The humidifier system 10 also includes a wet-pack assembly 100, which is fluidly coupled to the water source 15 such that fluid is communicated from the water source 15 to the wet-pack assembly 100. The water source 15 is in communication with the control module 20 according to which water from the water source 15 may flow to the wet-pack assembly 100 responsive to control signals from the control module 20. As shown, the humidifier system 10 also includes a circulation module 25, which is operably coupled to each of the control module 20 and the wet-pack assembly 100. The circulation module 25 may include one or more fans, blowers, or other mechanisms configured to facilitate circulation of air from the humidifying system 10 to a surrounding space. During operation, the humidifying system 10, responsive to a control signal from the control module 20, circulates water from the water source 15 to the wet-pack assembly 100. The circulation module 25 circulates air through the wet-pack assembly 100 where its humidity is increased due to evaporation of the water from the wet-pack assembly and the humidified air moved into the surrounding space.

Figure 3:
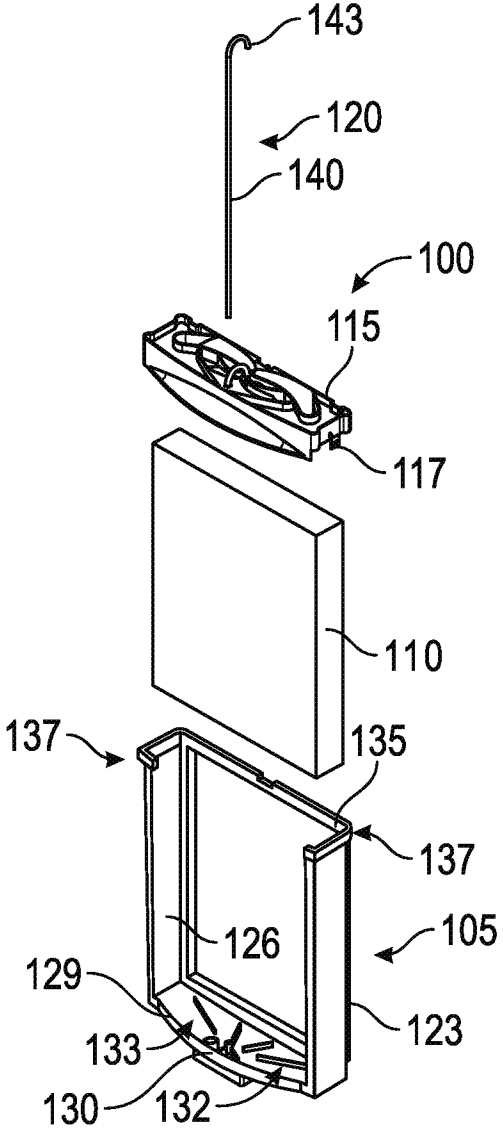
FIG. 3 is an exploded perspective view of the wet-pack assembly of FIG. 2, according to an exemplary embodiment.
Figure 2:
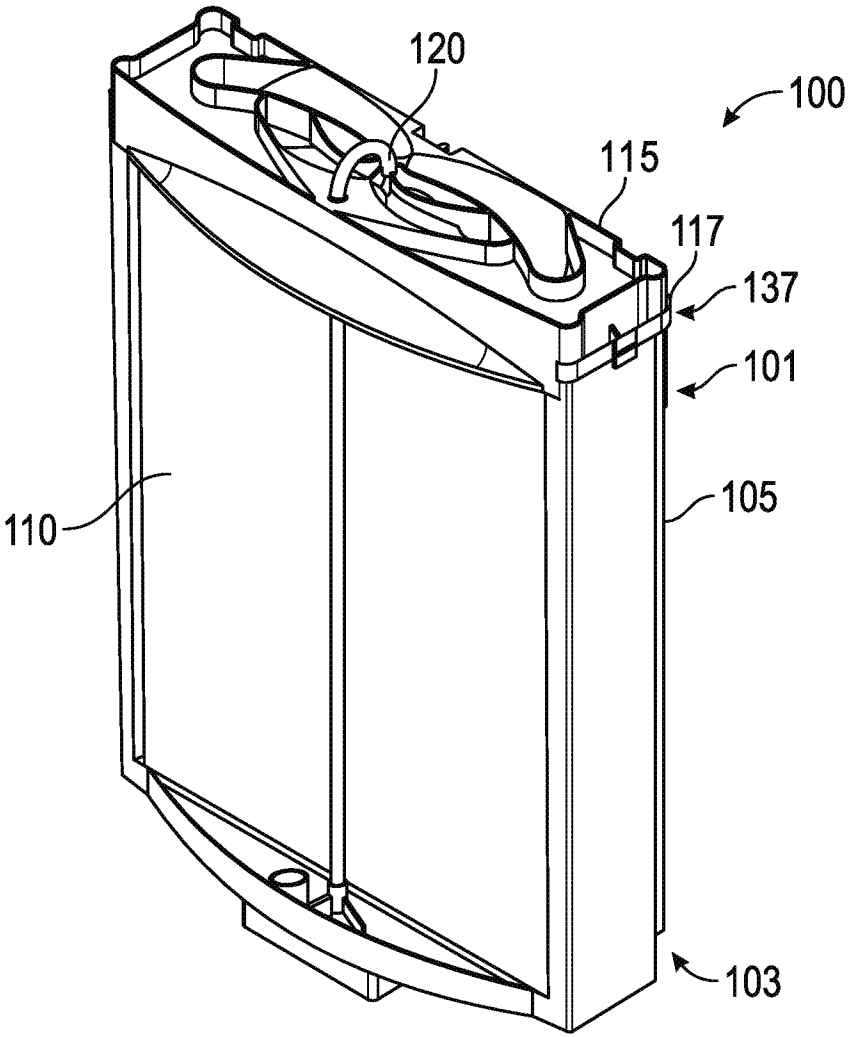
FIG. 2 is a perspective view of a wet-pack assembly of the humidifier system of FIG. 1, according to an exemplary embodiment.

FIGS. 2 and 3 show the wet-pack assembly 100, according to an exemplary embodiment. The wet-pack assembly 100 includes a first ("top") end 101 and a second ("bottom") end 103, where water flows from the first end 101 to the second end 103 through a water panel 110. The water panel 110 is structured as a meshed or otherwise porous structure having a surface area that allows water from the water panel 110 to be dispersed into a flow of air passing through the water panel 110 to increase humidity of the air. The water panel 110 receives water from a distribution tray 115, which is disposed at the first end 101 of the wet-pack assembly 100 and positioned on a top portion of the water panel 110. The distribution tray 115 may be fluidly coupled to the water source 15 and is structured to distribute water from the water source 15 to the water panel 110. The distribution tray 115 may include one or more features that facilitate substantially even water distribution such that air flowing through the water panel 110 is humidified. The water panel 110 is further enclosed within a scale control 105, which is configured to surround at least a portion of the water panel 110, e.g., on each of a first side 123, second side 126, and a third side 129, where the third side 129 is opposite the distribution tray 115. As shown, the scale control 105 also includes a rear support member 135 that extends between first side 123 and the second side 126, where an upper portion of each the sides 123 and 126 and the support member 135 may be configured to engage with and couple to the distribution tray 115.

The wet-pack assembly 100 also includes a feed tube 120, which extends between an eductor outlet 130 disposed within the third side 129 of the scale control 105 and the distribution tray 115. The feed tube 120 provides water to the distribution tray 115 for further dissemination to the water panel 110. In an embodiment, the feed tube 120 is configured to facilitate a return of collected water from the scale control 105 to the distribution tray 115 for redistribution to the water panel 110. Additionally, the feed tube 120 provides fresh water from a water supply (i.e., the water supply 15), which can be provided via one or more inlets, to the distribution tray 115. As shown in FIGS. 2-3, the feed tube 120 is positioned within a volume defined by the outer dimensions of a shell of the scale control 105 and may further be positioned at least partially between a basin of the scale control 105 and the distribution tray 115. In various embodiments, the feed tube 120 may be positioned on any side of the water panel 110 (e.g., in front, behind, or alongside) or may be positioned such that it passes within the water panel 110. Still further, the feed tube 120 may be a separate tube or conduit from the water panel 110 and scale control 105 or in some embodiments may be a molded passageway partially or entirely through one or more of the water panel 110 and the scale control 105. As described above, the wet-pack assembly 100 may be structured as a single cartridge unit, configured for installation into a variety of humidifying systems. Due to the unitary design, the wet-pack assembly 100 may be easily installed or removed from within humidifying systems without the need for corresponding assembly or disassembly of separate components (e.g., feed tube 120, water panel 110, distribution tray 115, etc.).

As shown, the eductor outlet 130 is disposed within a lowest point of the third side 129 of the scale control 105 such that excess water from the water panel 110 is collected in the scale control 105 and flows toward the eductor outlet 130 as optionally facilitated by one or more inclined channels 132. The eductor outlet 130 is an outlet of a venturi pump-type eductor as discussed for example in related U.S. patent application Ser. No. 18/093,058, incorporated herein by reference. The feed tube 120 includes a first portion 140 and a second portion 143, where the first portion 140 is coupled to or received within the eductor outlet 130 and extends in a direction that is substantially parallel to the water panel 110 through the distribution tray 115. The second portion 143 is coupled to an end of the first portion 140 that extends through the distribution tray 115 and curves relative to the first portion 140 such that water from eductor outlet 130 is redirected to a substantially central portion of the distribution tray 115. In an embodiment, the second portion 143 of the feed tube 120 is separable from the first portion 140 and the rest of the wet-pack assembly. For example, a first end of the second portion 143 may be configured to connect (e.g., via a press fit connection or other suitable connection) to a pocket or connector within a bottom side of the distribution tray 115 and a second end of the second portion 143 may be configured to connect (e.g., via a press fit connection or other suitable connection) to a pocket or connector on a top side of the distribution tray 115 (e.g., at or near a flow divider 147).

Figure 4:
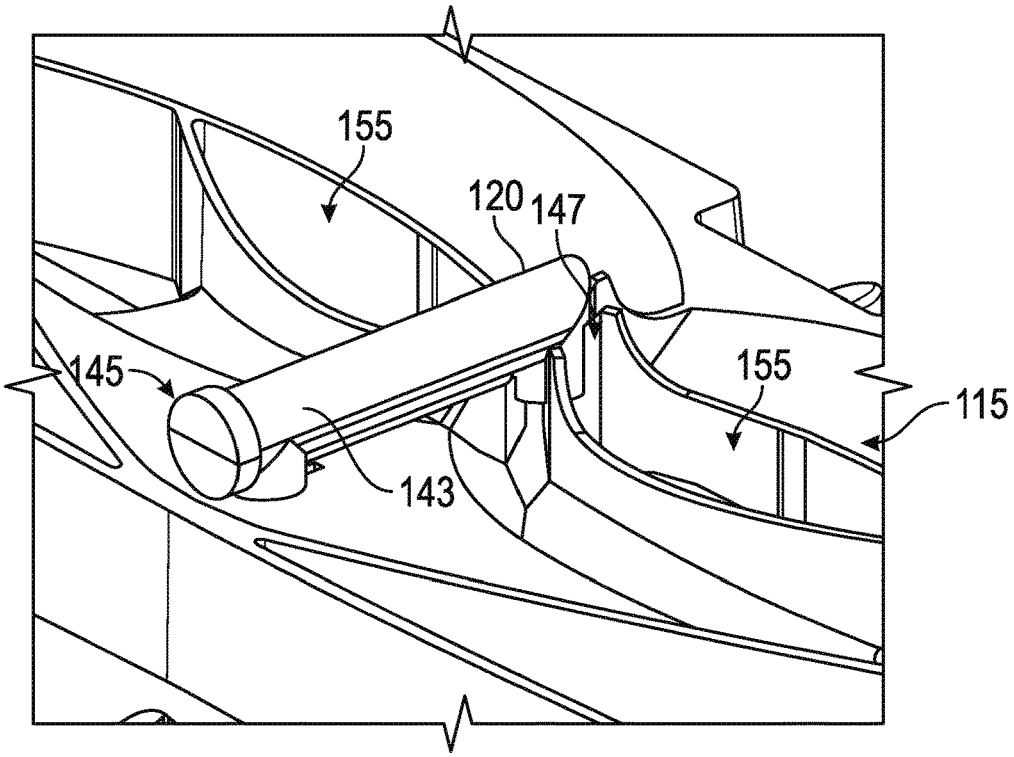
FIG. 4 is a perspective view near a distribution tray of the wet-pack assembly of FIG. 2, according to an exemplary embodiment.

As depicted for example in FIG. 4, different shaped portions of the feed tube 120 are envisioned. For example, the second portion 143 may extend in a straight direction at an approximately right angle from the first portion 140 such that first portion 140 extends approximately parallel to a top surface of the distribution tray 115. Accordingly, water is collected within a basin 133 formed by the third side 129 of the scale control 105 and is drawn into the eductor and through the eductor outlet 130 into the first portion 140 of the feed tube 120, where the water then flows upward in a direction parallel to the water panel 110. Water from the first portion 140 then flows into the second portion 143 to be redirected downward toward the distribution tray 115 to be redistributed to the water panel 110. In various embodiments, the first portion 140 and the second portion 143 are integrally formed. In other embodiments, the first portion 140 and the second portion 143 may be separate components that are coupled together.

In various embodiments, the distribution tray 115 is configured to couple to the scale control 105. In some embodiments, the distribution tray 115 may include one or more features to facilitate permanent coupling of the scale control 105 to the distribution tray 115. For example, in some embodiments, the distribution tray 115 may include one or more retention features 117, which are structured to engage with an upper portion 137 of each of the first side 123 and the second side 126 of the scale control 105. In various embodiments, the retention features 117 may include one or more ridges, grooves, clips, flanges, clasps, brackets, or any other feature that may facilitate an interference fit with the upper portion 137 of each of the sides 123, 126. In various embodiments, the distribution tray 115 may be coupled to the upper portion 137 via one or more permanent joints such as via heat staking, sonic welding. Permanently coupling the distribution tray 115 to the scale control 105 to form a unitary wet-pack assembly 100 encloses the water panel 110 and reduces risk of water leakage. Furthermore, such a configuration (optionally including permanently mounting at least a portion of the feed tube 120 between the permanent connection between the distribution tray 115 and the scale control 105) may prevent misalignments, disconnections, or degradation of parts during use as permanent joints between the distribution tray 115 and the scale control 105 reduces risk of movement or shift therebetween.

To reduce water use, the feed tube 120 is configured to recirculate water collected within the scale control 105 to the water panel 110 via the distribution tray 115, as described above. As shown in FIG. 4, the second portion 143 of the feed tube 120 is configured to extend through an aperture 145 disposed within the distribution tray 115 and couple to a flow divider 147 within the distribution tray 115. In some embodiments, the second portion 143 of the feed tube 120 is connected to a corresponding opening, portion, or connector on the distribution tray 115, for example, by a press-fit connection, collar, or other suitable connector, and the first portion 140 of the feed tube 120 is permanently connected on a bottom side of the distribution tray 115 to a corresponding opening, portion, or connector that is in fluid communication with the second portion 143 via its connector. Accordingly, water flowing through the second portion 143 flows to the flow divider 147 and is distributed to channels 155, which then distribute fresh and/or recirculated water to the water panel. 110. In various embodiments, the second portion 143 may be press fit within the flow divider 147. In other embodiments, the second portion 143 may be coupled to the flow divider 147 via any other interference-type fit. In some embodiments, the aperture 145 is disposed within a front portion of the distribution tray 115. In other embodiments, the aperture 145 is disposed within a rear portion of the distribution tray 115. In yet other embodiments, the aperture 145 is disposed within a side portion of the distribution tray 115 such that the feed tube is substantially aligned with one of the first side 123 or the second side 126 of the scale control 105. In other embodiments, the feed tube 120 and the aperture 145 may extend through an inner portion of the water panel 110.

Figure 5:
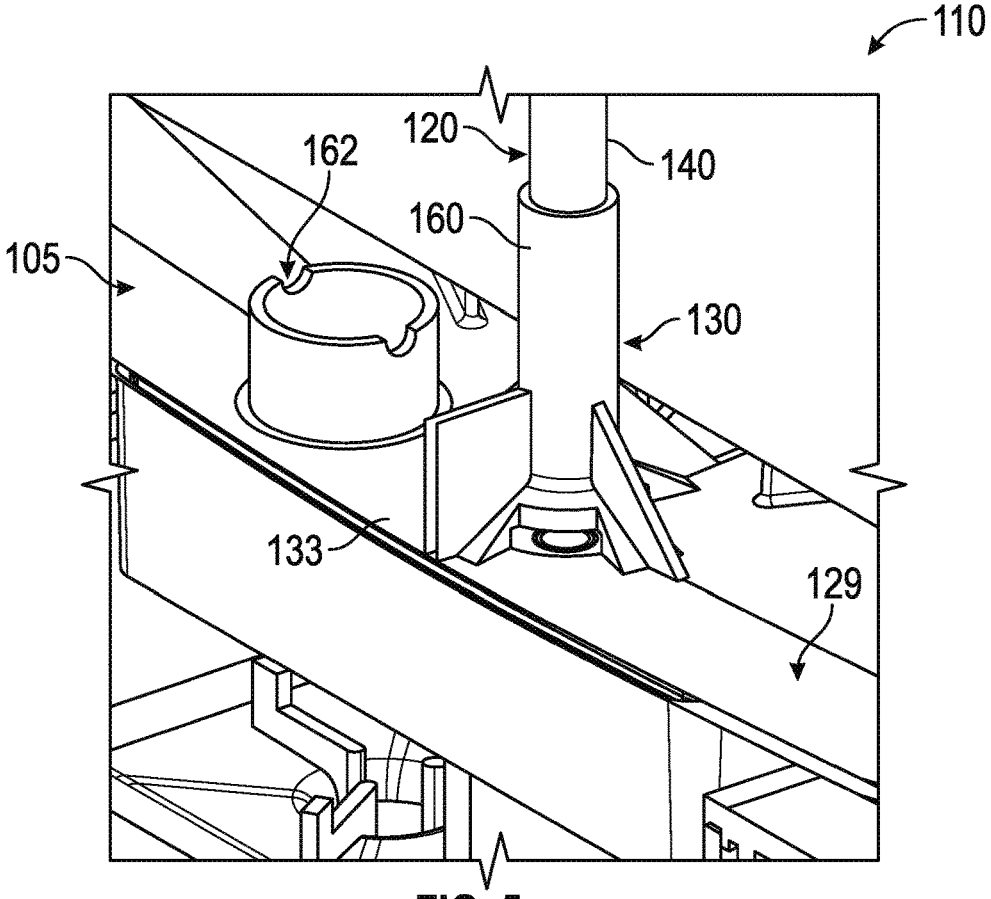
FIG. 5 is a perspective view near a scale control tray and eductor outlet of the wet-pack assembly of FIG. 2, according to an exemplary embodiment.

As shown in FIG. 5, and as described above, the first portion 140 of the feed tube 120 is received within the eductor outlet 130 such that water collected within the third side 129 of the scale control 105 (i.e., as received from the water panel 110) is drawn into the feed tube 120 and recirculated to the distribution tray 115 to be redistributed to the water panel 110. As shown, the eductor outlet 130 may include a collar 160, which may be integrally formed with the third side 129 of the scale control 105. Accordingly, the first portion 140 of the feed tube 120 is configured to be received within the collar 160 to enable water from the scale control 105 to be drawn into the feed tube 120. In some embodiments, the eductor is structured to operate during a startup period, prior to initiation of water recirculation through the water panel 110 and wet-pack assembly 100. For example, during the startup period, until a threshold amount of water collects in the basin 133, the eductor within the wet-pack assembly 100 may be structured to cause hot air to flow through the one or more waterflow inlets (e.g., through the feed tube 120 and/or one or more inlets fluidly connected thereto) such that the hot air raises a temperature of water flowing to the distribution tray 115. In some embodiments, the startup period can be 5 minutes. In other embodiments, the startup period could be any duration of time (e.g., 30 seconds, 1 minute, 2 minutes, 3 minutes, 5 minutes, etc.).

In various embodiments, the first portion 140 may be press fit into the collar 160. The first portion 140 of the feed tube 120 may also be pressed over a barb on the eductor or other mechanisms for retaining the feed tube 120 in fluid connection with the eductor and the eductor outlet 130. In other embodiments, at least one of the first portion 140 or the collar 160 may include one or more retention features (e.g., ridges, grooves, etc.) to form an interference fit between the first portion 140 and the collar 160. The first portion 140 of the feed tube 120 may be permanently joined to the collar 160. The scale control 105 also includes one or more outlets 162, which allow water to flow away from the wet-pack assembly 100. The formed feed tube 120 integrated into the wet-pack assembly 100 improves performance reliability of the wet-pack assembly 100 (and thus of the humidifier system 10) by eliminating the need to disconnect and reconnect components during service. Furthermore, by incorporating the feed tube 120 into the wet-pack assembly 100 by directly connecting the first portion 140 with the eductor outlet 130 (e.g., via the collar 160) and the second portion 143 with the flow divider 147 of the distribution tray 115, the design of the wet-pack assembly 100 facilitates a controlled and evenly distributed flow of water through the humidifier system 10. In some embodiments, the eductor outlet 130 is formed by one or more apertures (e.g., slots, holes, etc.) disposed within the collar 160.

Figure 6:
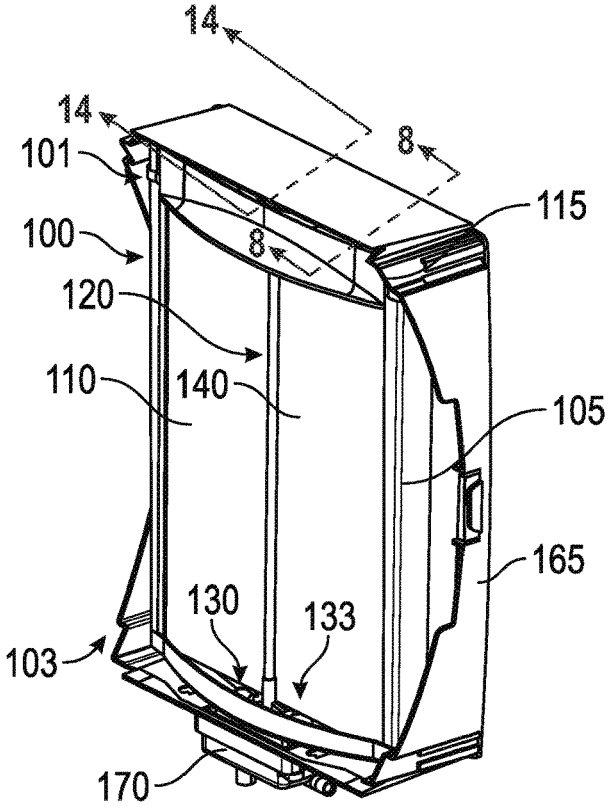
FIG. 6 is a perspective view of the wet-pack assembly of FIG. 2 disposed within a humidifier base, according to an exemplary embodiment.

As illustrated in FIG. 6, the wet-pack assembly 100 may be structured to fit within a base component ("base") 165. The base 165 is further coupled to a collection member 170 (also referred to as a solenoid valve and drain assembly), which is disposed at a bottom portion of the base 165 and fluidly coupled to wet-pack assembly 100 via the scale control 105 and/or to the base 165. The collection member 170 is structured to collect water expelled from the scale control 105. In some embodiments, the base 165 may be integrally formed with and/or part of the collection member 170. In other embodiments, the base 165 and the collection member 170 may be separate components. In various embodiments, the scale control 105 is configured to pass through the bottom portion 165 of the base to mount to the collection member 170. Such a configuration allows for the collection member 170 to be selectively separable from the scale control 105 (and thus the wet-pack assembly 100). The configuration also facilitates an open drain path within the humidifier system 10 and creates a controlled path for any internal leak within the humidifier system 10 to flow to the collection member 170 to prevent potential external leaks.

Figure 7:
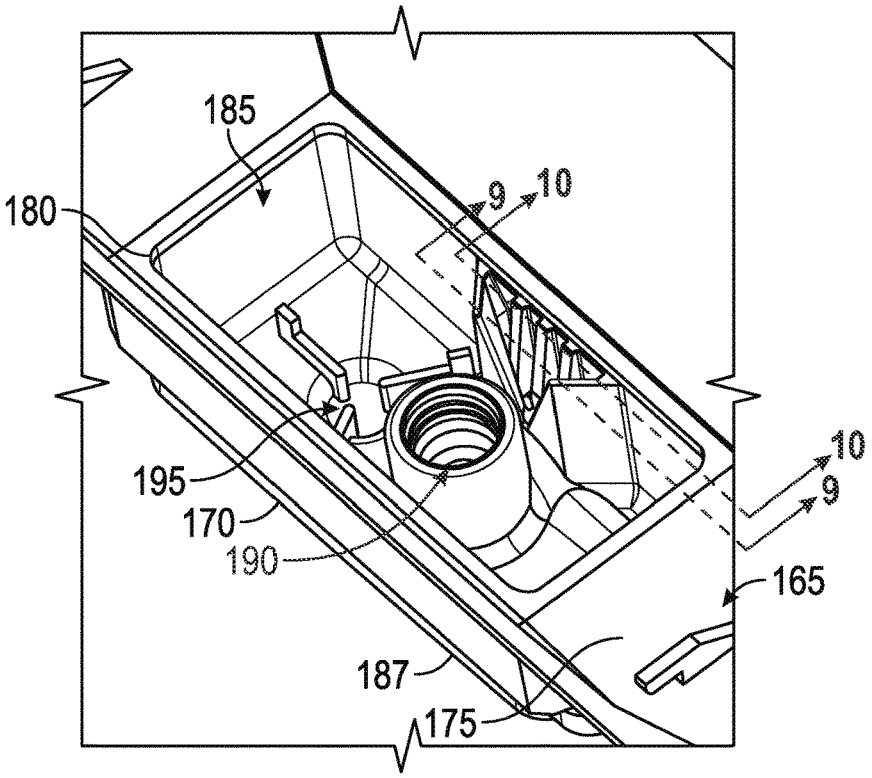
FIG. 7 is a perspective view of a bottom portion of the base of FIG. 6, according to an exemplary embodiment.

As shown in FIG. 7, the base 165 includes a lower side 175, which is structured to be disposed adjacent the third side 129 of the scale control 105 when the wet-pack assembly 100 is disposed within the base 165. The lower side 175 of the base 165 includes an opening 180, which is disposed within a lower point of the lower side 175 and is in fluid communication with the collection member 170. The collection member 170 includes an outer housing 187 that defines an inner cavity 185 that forms a drain opening. As illustrated, the collection member 170 includes a first aperture 190 and a second aperture 195. In various embodiments, the first aperture 190 may be configured to couple to an orifice (optionally in combination with a check valve), which when mated with a corresponding valve seat on the scale control 105, creates an eductor that may draw water collected in a basin of the scale control 105 and recirculate it via the eductor outlet 130 to the distribution tray 115. In various embodiments, the second aperture 195 is fluidly coupled to a drain outlet to facilitate water flow away from the humidifier system 10.

Figure 8:
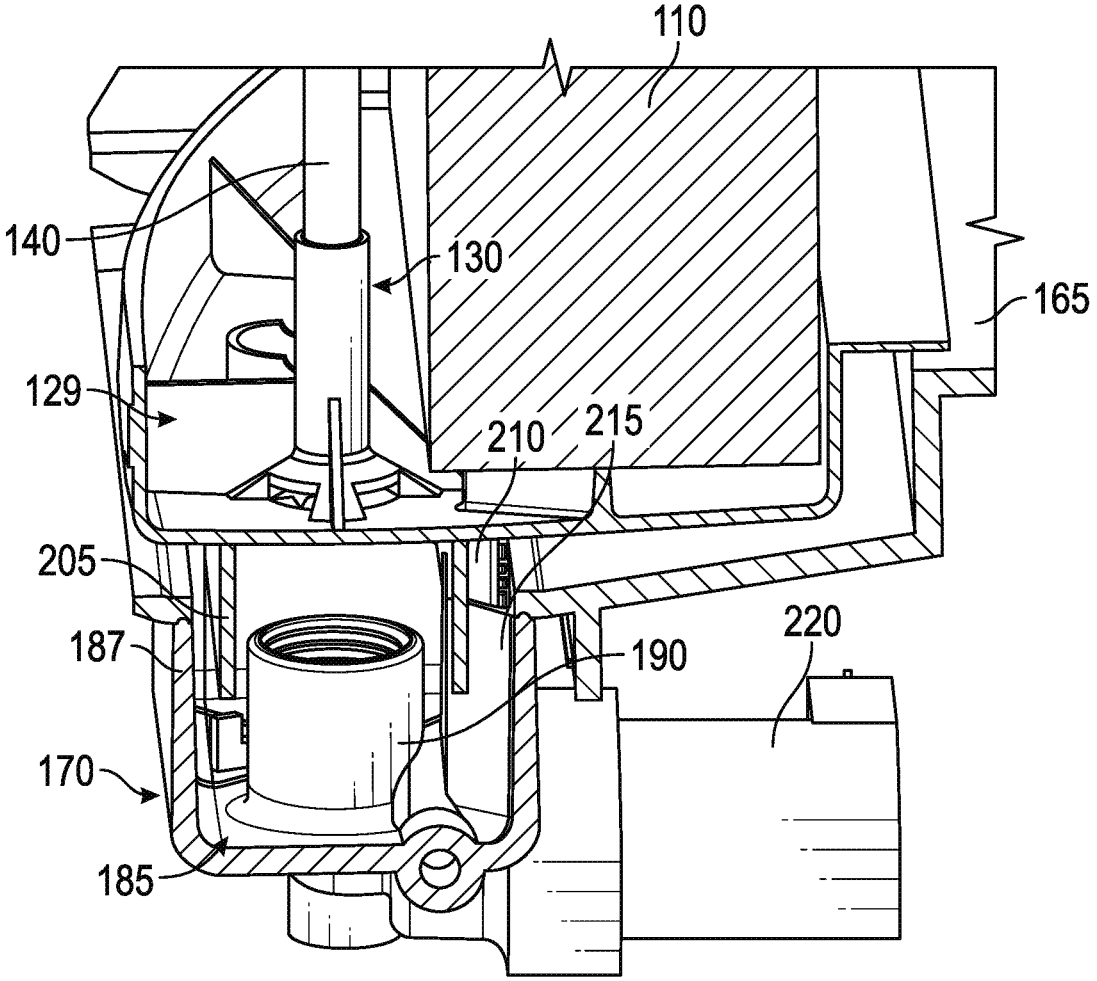
FIG. 8 is a cross-sectional view of the wet-pack assembly of FIG. 6, taken along line 8-8 of FIG. 6, according to an exemplary embodiment.

To prevent leaks, the third side 129 of the scale control 105 may extend through the opening 180 in the lower side 175 of the base 165 such that it protrudes into the collection member 170, as shown in FIG. 8. As illustrated, the third side 129 of the scale control 105 includes a placement feature such as shingling feature 205, which extends downward away from the third side 129. The shingling feature 205 is configured to fit within the outer housing 187 of the collection member 170 to form a nested or shingled arrangement. To retain the shingling feature 205 within the housing 187, a dovetail protrusion 210 disposed on a rear side of the shingling feature 205 is structured to engage with a pocket 215 disposed on an inner portion of the housing 187 of the collection member 170. The dovetail protrusion 210 is configured to facilitate easy sliding engagement between the scale control 105 and the collection member 170 and retain a relative and precise position of the scale control 105 to the collection member 170 such that water from the scale control 105 may flow into the drain opening formed by the cavity 185 and be directed away from the humidifier system 10 via one or more drain conduits 220, which are fluidly coupled to the collection member 170 and such that an orifice component attached to the collection member 170 is appropriately positioned relative to a valve seat of the scale control 105.

Figure 9:
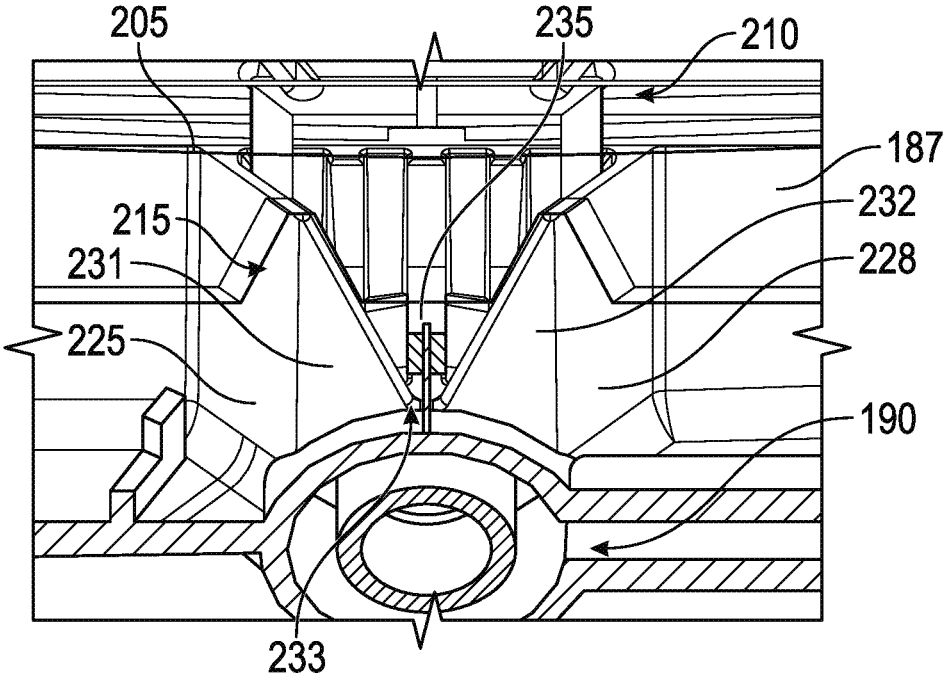
FIG. 9 is a cross-sectional view of the wet-pack assembly of FIG. 6, taken along line 9-9 of FIG. 7, according to an exemplary embodiment.
Figure 10:
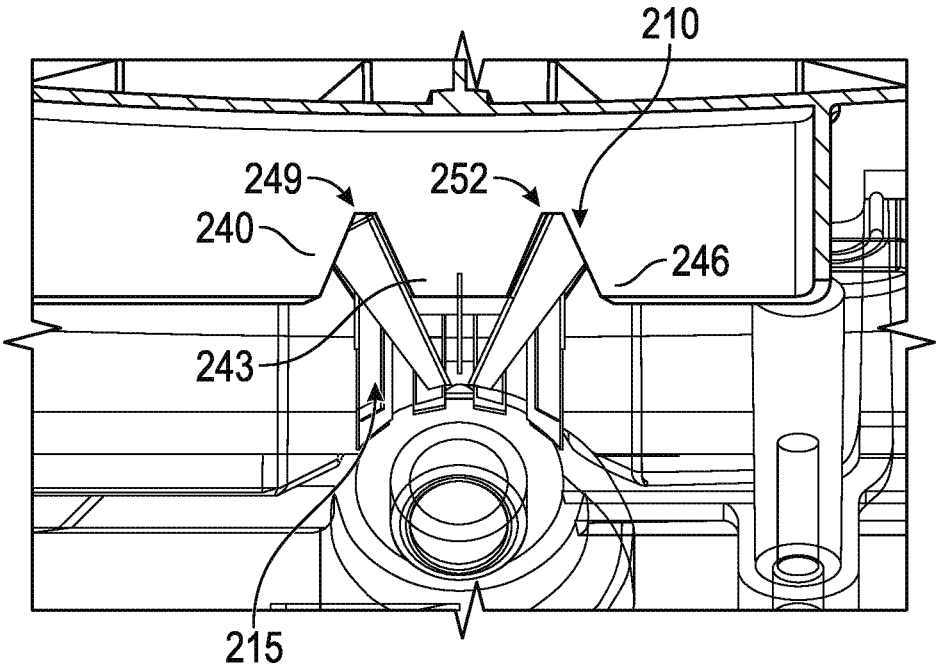
FIG. 10 is a cross-sectional view of the wet-pack assembly of FIG. 6, taken along line 10-10 of FIG. 7, according to an exemplary embodiment.

As illustrated in FIGS. 9 and 10, the dovetail protrusion 210 extends from the shingling feature 205 and is received within the pocket 215 of the housing 187. As shown, the pocket 215 includes a first side wall 225 and a second side wall 228, which extend away from the housing 187 at mirroring angles. The first side wall 225 and the second side wall 228 respectively connect to a first wall portion 231 and a second wall portion 232. As shown, the first wall portion 231 and the second wall portion 232 are disposed to be substantially collinear and are structured to form a roughly v-shaped slot 233 therebetween. The pocket 215 may also include one or more ribs 235, which may be integrally formed with a portion of the housing 187 and are configured to engage corresponding a mating surface of the dovetail protrusion 210 to facilitate positioning and retention of the dovetail protrusion 210 within the pocket 215.

Figure 11:
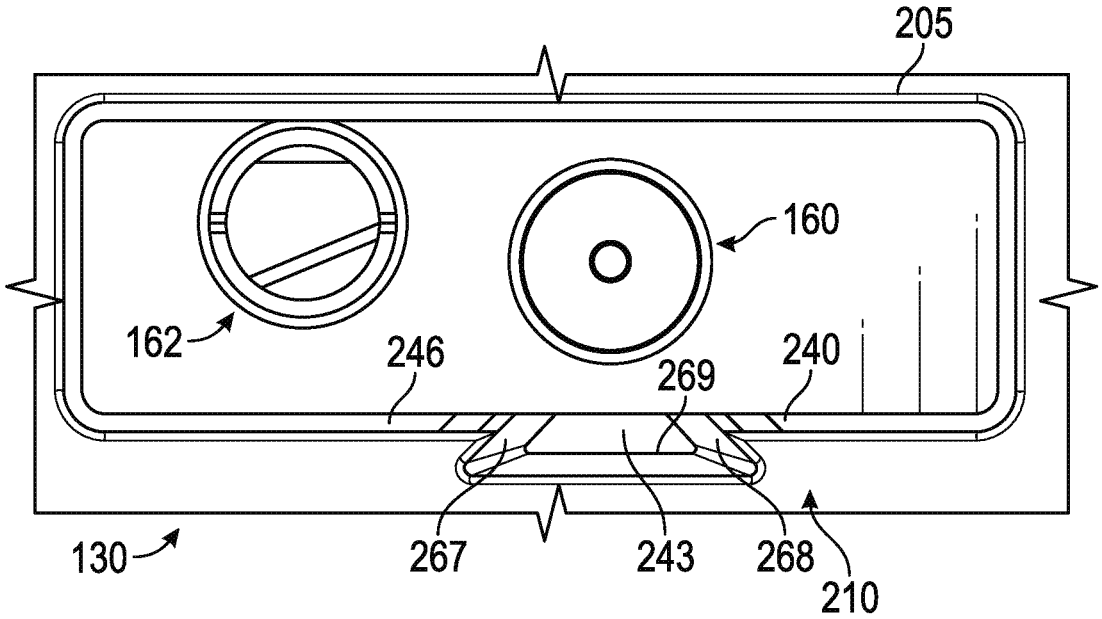
FIG. 11 is a bottom view of a scale control tray of the wet-pack assembly of FIG. 6, according to an exemplary embodiment.
Figure 12:
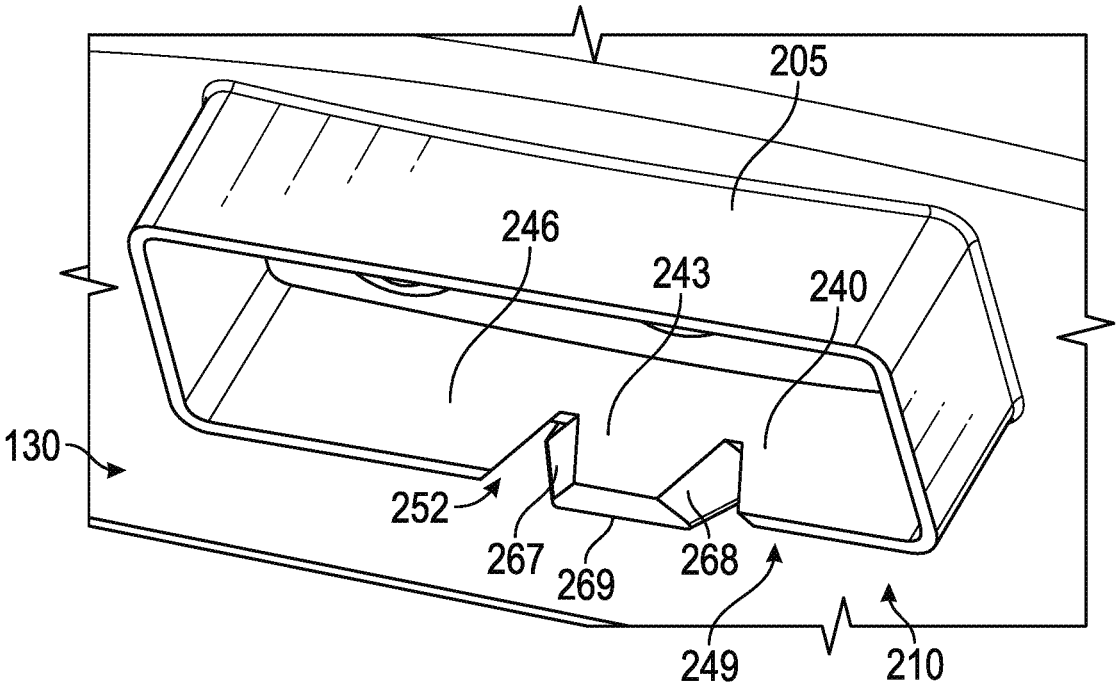
FIG. 12 is a perspective view of the scale control tray of FIG. 11, according to an exemplary embodiment.

As shown in FIGS. 11 and 12, a side of the dovetail protrusion 210 includes three primary engagement surfaces 267, 268, and 269 for engaging corresponding surfaces of the pocket 215 that are defined by one or more of a first portion 240, a second portion 243, and a third portion 246 of the shingling feature 205. The first portion 240 and the second portion 243 are separated by a first v-shaped slot 249, and the second portion 243 and the third portion 246 are separated by a second v-shaped slot 252. Note that as depicted in FIGS. 9 and 10, the v-shaped slot may in some embodiments have a flat bottom and need not necessarily come to a sharp point. In one embodiment, engagement surface 267 is formed along a side of the first v-shaped slot 252, engagement surface 268 is formed along a side of the second v-shaped slot 249, and engagement surface 268 is formed on a rear side of the second portion 243. In various embodiments, one or more of the engagement surfaces 267, 268, and 269 may be include beveled edges of the first portion 240, second portion 243, and/or third portion 246. Such beveled edges and corresponding engagement surfaces mate with correspondingly shaped surfaces within the pocket 215 to ensure a secure and precise mating between the scale control 105 and the collection member 170.

Accordingly, when the dovetail protrusion 210 is positioned within the pocket 215, the second portion 243 fits between the first side wall 225 and the second side wall 228 and the first and second v-shaped slots 249 and 252 respectively sit on the first side wall 225 and the second side wall 228. As shown in FIGS. 11 and 12, the shingling feature 205 has a substantially rectangular shape, which is complementary to a shape of the housing 187 and facilitates a nested or shingled arrangement, as described above. In addition, as illustrated, the second portion 243 of the dovetail protrusion 210 may be substantially trapezoidal in shape and may be structured to have a greater width than the first and third portions 240 and 246. Accordingly, the second portion 243 may extend outward relative to the shingling feature 205.

Figure 13:
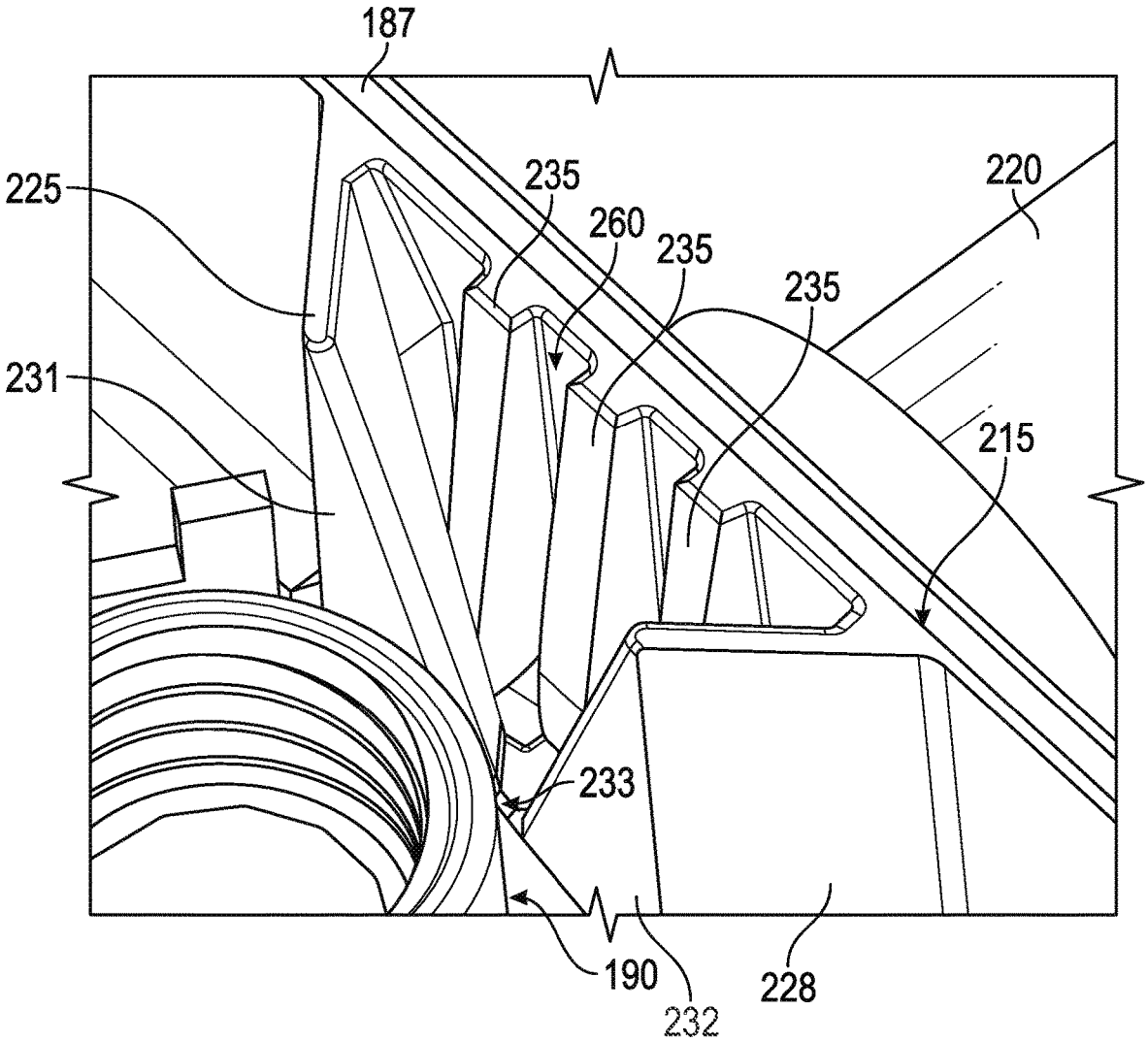
FIG. 13 is a perspective view of a solenoid valve portion of the wet-pack assembly of FIG. 6 near a pocket, according to an exemplary embodiment.

As described above, the pocket 215 may include one or more ribs 235 to form a corresponding mating surface with dovetail protrusion 210. As shown in FIG. 13, the pocket 215 may include a series of ribs 235 disposed along an inner surface 260 of the housing 187 contained within the pocket 215. As shown in FIG. 13, the one or more ribs 235 may be evenly spaced along the inner surface 260. Each of the ribs 235 may have a constant or varying thickness. For example, as shown in FIG. 13, a thickness of each of the ribs 235 may decrease from an end of each rib 235 disposed adjacent a base of the pocket 215 to an end of each rib 235 adjacent an upper edge of the housing 187. In various embodiments, at least one of the first side wall 225, first side portion 231, second side wall 228, and second side portion 232 may have a variable thickness. For example, a thickness of the first side wall 225 and/or second side wall 228 may decrease from bottom to top. In various embodiments, each of the first and second side walls 225, 228 and each of the ribs 235 may have a decreasing thickness from a base portion of the pocket 215 to a top edge of the pocket 215 to create a wedge effect, which may facilitate retention of the dovetail protrusion 210 in the pocket 215.

Figure 14:
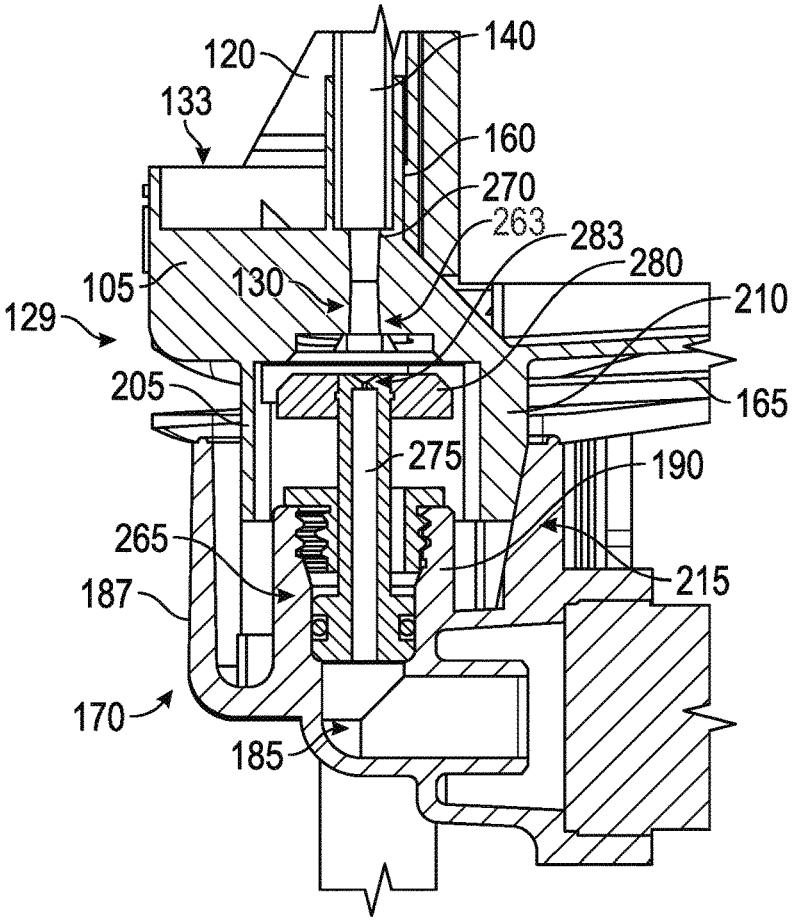
FIG. 14 is a side cross-sectional view of the wet-pack assembly of FIG. 6, taken along line 14-14 of FIG. 6, according to an exemplary embodiment.

The eductor outlet 130 is fluidly coupled to an eductor 263, as shown in FIG. 14. The scale control 105 includes venturi portion ("converging/diverging nozzle") 270, which is positioned within the third side 129 of the scale control 105, where the third side 129 of the scale control 105 forms the recirculation basin 133 and eductor intake (including one or more openings which may serve as primary drain ports and/or secondary drain openings). The third side 129 of the scale control 105 is mated to a check valve assembly 265 and orifice 283, which are housed within the collection member 170. The check valve assembly 265 and orifice 283 form the functional assembly of the eductor 263, which facilitates water recirculation from the basin 133 formed in the third side 129 (i.e., bottom) of the scale control 105 back up to the distribution tray 115.

Figure 15:
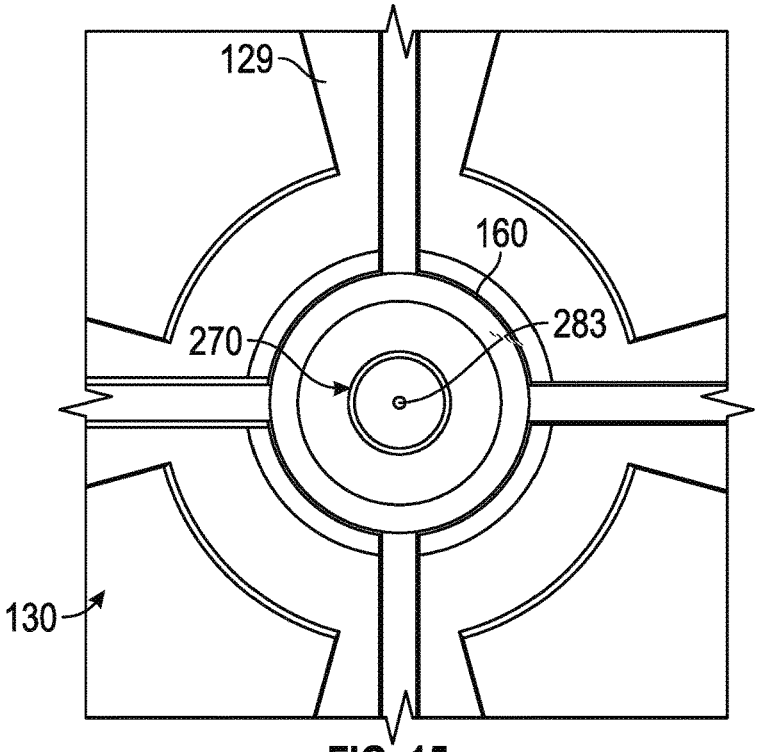
FIG. 15 is a top view of the scale control tray of the wet-pack assembly of FIG. 6 with the feed tube removed, according to an exemplary embodiment.

As shown in FIG. 14, the check valve assembly 265 includes a check valve 275 and a seal 280, which articulate relative to the scale control 105 and the collection member 170 to control flow of water through the check valve assembly 265. Operation of the check valve assembly 265 and the orifice 283 are discussed in more detail in U.S. patent application Ser. No. 18/093,058, which is incorporated herein by reference. As shown in FIGS. 14 and 15, each of the first portion 140 of the feed tube 120, the venturi portion 270, and the orifice 283 are coaxial, which reduces leakage and ensure efficient water flow through the eductor 263 and check valve assembly 265.

Figure 16:
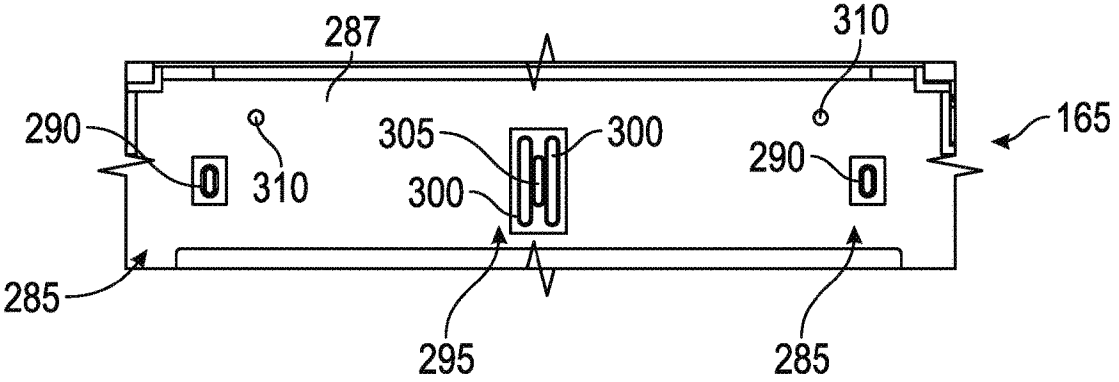
FIG. 16 is a front view of the base of FIG. 6 near a top portion, according to an exemplary embodiment.

The wet-pack assembly 100 includes one or more features to facilitate placement and retention within the base 165 (and thus within the humidifier system 10). As shown in FIG. 16, the base 165 may include placement features 285 disposed near opposing edges of an interior surface 287, where the surface 287 is configured to interface with a rear portion of the distribution tray 115. In various embodiments, the base 165 includes a first placement feature 285 disposed near a first edge and a second placement feature disposed near a second edge. Each of the placement features 285 may include one or more apertures, detents, or recesses, which are structured to receive a corresponding protruding portion of the distribution tray 115. The surface 287 of the base 165 may further include a snap feature 295 disposed between the placement features 285 (e.g., between the first and second placement features 285). The mount feature 295 may include a central aperture (e.g., slot) 305 sandwiched between two outer apertures 300, which allow for ribs between the central aperture 305 and respective outer aperture 300 to flex outwardly upon insertion of a snap feature 325 into central aperture 305. Furthermore, as shown in FIG. 16, the base 165 may include one or more apertures 310 disposed within the surface 287, which may engage with protruding features within the humidifier assembly 10 to prevent displacement of the base 165 relative to nearby components and/or are usable for engagement with fasteners for mounting of the humidifier system in a desired location (e.g., to a plenum).

Figure 17:
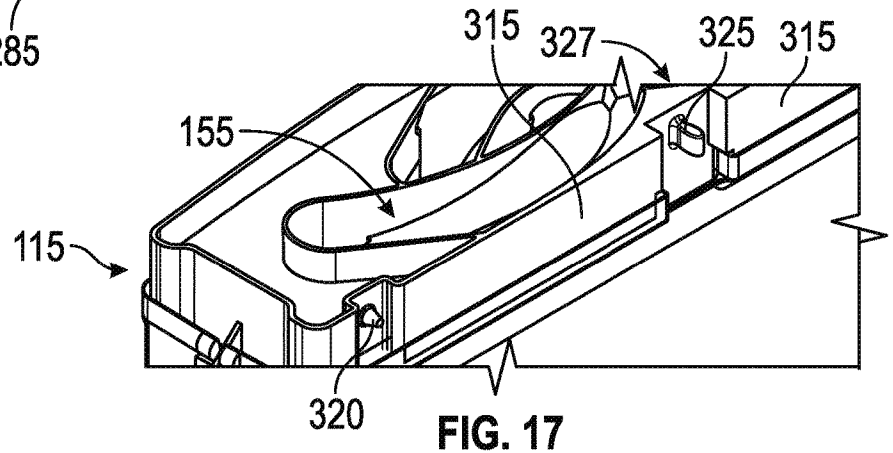
FIG. 17 is a rear perspective view of the wet-pack assembly of FIG. 6 near the distribution tray, according to an exemplary embodiment.
Figure 18:
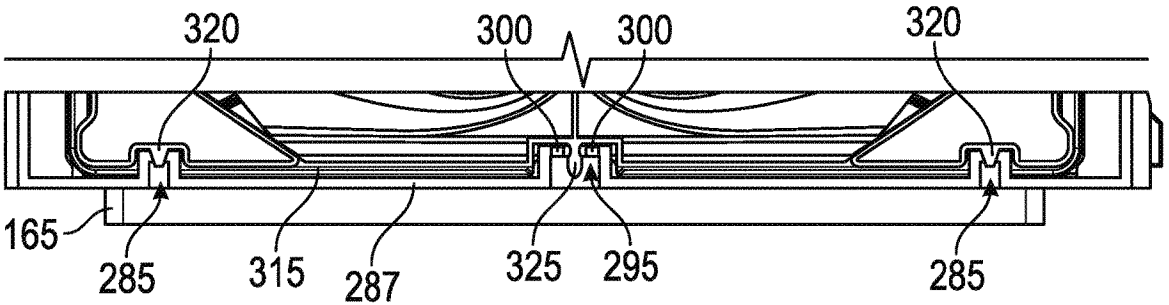
FIG. 18 is a cross-sectional top view of the wet-pack assembly of FIG. 6 near a rear portion, according to an exemplary embodiment.

As shown in FIGS. 17 and 18, the distribution tray 115 of the wet-pack assembly 100 includes protrusions 320 disposed near opposing edges of a rear surface 315, where the surface 315 is configured to interface with the surface 287 of the base 165. In some embodiments, the distribution tray 115 may include a first protrusion 320 disposed near a first edge of the surface 315 and a second protrusion 320 disposed near a second edge of the surface 315. In various embodiments, the surface 315 is disposed on a side of the distribution tray 115 opposite a side of the distribution tray 115 having the aperture 145, which accommodates the feed tube 120. In various embodiments, the protrusions 320 may be structured as pegs, posts, pins, cones, knobs, or any other suitable shape. The distribution tray 115 also includes a snap feature 325 disposed between the protrusions 320 (i.e., between the first and second protrusions 320). In various embodiments, the snap feature 325 may be positioned within a recess 327 disposed within the surface 315. The snap feature 325 may be structured as a post, peg, or pin having a width that is smallest at its terminal end and at its base (i.e., where the snap feature 325 is joined to the surface 315). In various embodiments, the snap feature 325 may be formed of a single component. In other embodiments, the snap feature 325 may be formed of two opposing members, each bent (or curved) to create a variable width of the snap feature 325. In some embodiments, the snap feature 325 may be integrally formed with the distribution tray 115. In other embodiments, the snap feature 325 may be coupled to the distribution tray 115.

As shown in FIG. 18, the wet-pack 100 is structured to be coupled to the base 165 via the distribution tray 115. To facilitate placement and coupling, the wet-pack 100 may be inserted into the base 165 such that the surface 315 is disposed to interface with the surface 287 of the base 165. The protrusions 320 may each be inserted into respective placement features 285 to align the wet-pack assembly 100 with the base 165. The snap feature 325 may be aligned with and pressed into the aperture 305 to create and interference fit, which may prevent separation of the distribution tray 115 (and thus the wet-pack assembly 100) from the base 165. The ridges 300 may also fit within the recess 327 to prevent shifting and separation of the wet-pack assembly 100 from the base 165. In various embodiments, the aperture 305 and/or the placement features 285 may be beveled or otherwise contoured such that as the protrusions 320 and the snap feature 325 are respectively pressed into the placement features 285 and the aperture 305, a ramp like action between the compound angles (i.e., formed by the contours of the aperture 305 and/or the placement features 285) forces the wet pack assembly 100 downwards to firmly seat the dovetail protrusion 210 within the pocket 215 and aligning critical components of the eductor 263.

Figure 19A:
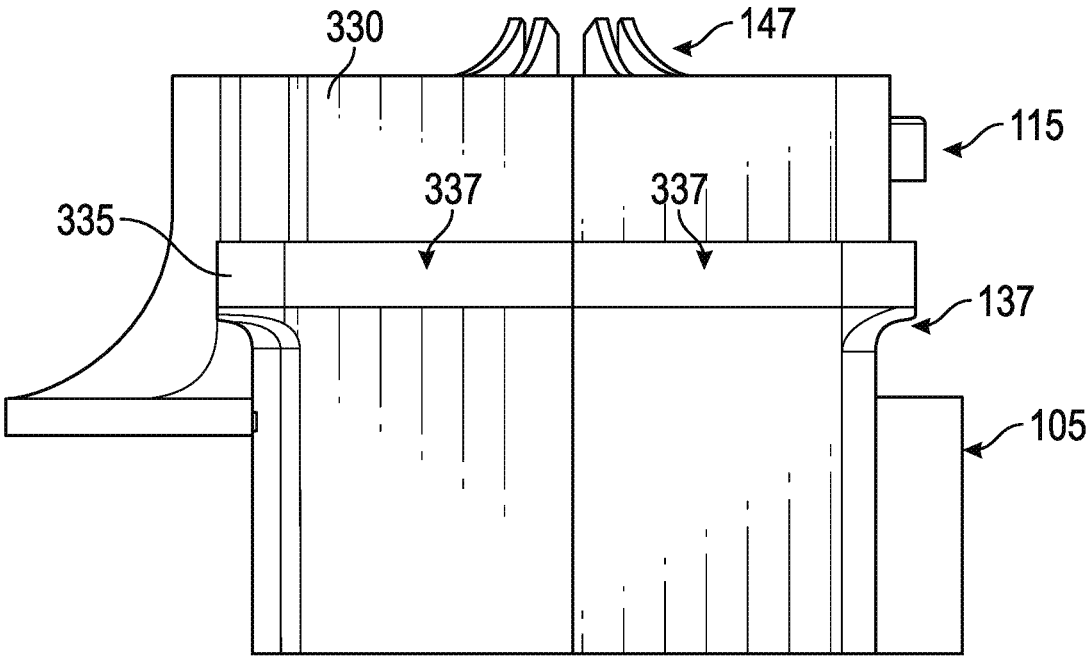
FIG. 19*a* is a side view of the wet-pack assembly of FIG. 2, according to an exemplary embodiment.

The wet-pack assembly 100 may also include one or more features to facilitate alignment and coupling of components. In various embodiments, such as shown in FIG. 19*a*, the scale control 105 may include a lip or ridge 335 disposed along the upper portion 137 such that a bottom region of an outer wall 330 of the distribution tray 115 is structured to fit within the ridge 335. Accordingly, the ridge 335 may prevent lateral displacement or shift of the distribution tray 115 relative to the scale control 105 and other adjacent components. In various embodiments, the distribution tray 115 may be coupled to the scale control 105 via a press fit. For example, the wall 330 of the distribution tray 115 may be press fit within the ridge 335 of the upper portion 137. In other embodiments, the distribution tray 115 may be permanently coupled to the scale control 105. For example, in various embodiments, the wall 330 of the distribution tray 115 may be coupled to the ridge 335 at one or more locations 337 via heat staking and/or welding (e.g., sonic welding) to prevent separation of the distribution tray 115 from the scale control 105. In other embodiments, the wall 300 of the distribution tray 115 may be coupled to the scale control 105 via one or more fasteners, adhesives, or any other suitable method (e.g., hinge and lock). Permanently joining these components may facilitate efficient water retention within the wet-pack assembly 100 and prevent leakage due to misalignment or shift (e.g., during installation, service, or use). Permanently joining these components also allows for preloading distribution tray leaf features (e.g., water outlets) into the water panel 110 to improve tolerances of the assembly and fit of the water panel 110 into the surrounding components. Preloading and permanent mating may also ensure an air tight seal and burying the outlets may also help with ensuring water is delivered directly into the water panel 110, preventing falling drops from being exposed to gravity or airflow forces that cause leaks in certain installations without these features. In various embodiments, the distribution tray 115 may be coupled to the ridge 335 along a continuous perimeter of the wall 330. In other embodiments, the distribution tray 115 may be coupled to the ridge 335 at the discrete locations 337, which may be evenly distributed about the perimeter of the wall 330. In other embodiments, the locations 337 may be concentrated along one or more sides of the scale control 105, such as along the first side 123 and/or the second side 126.

Figure 20A:
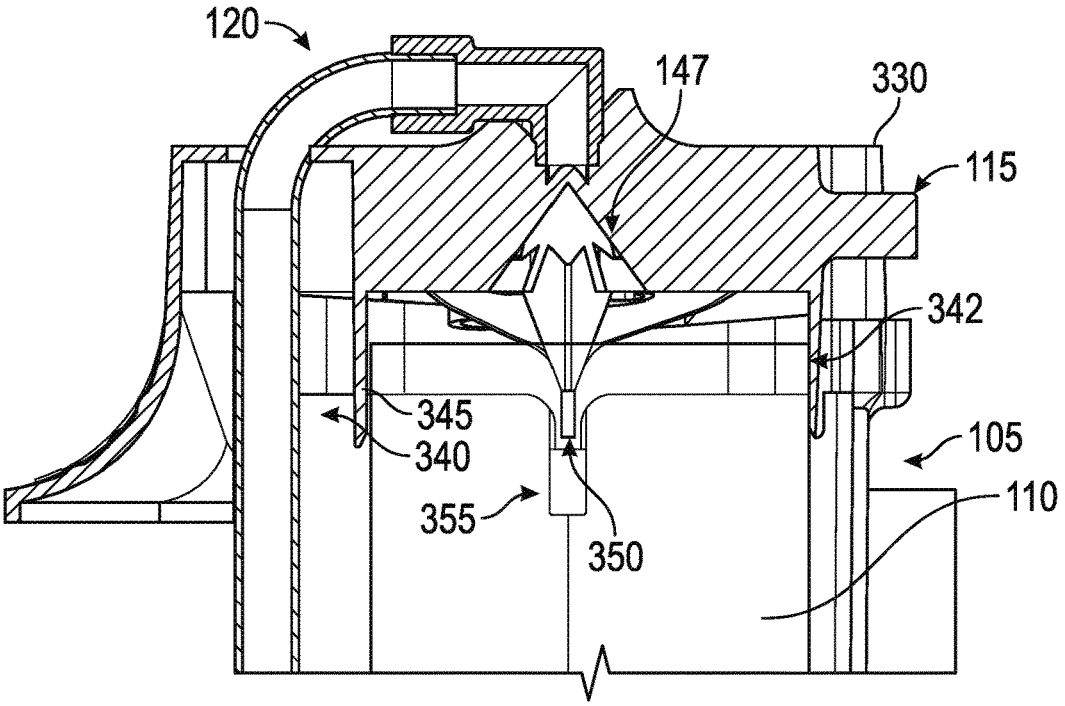
FIG. 20*a* is a side cross-sectional view of the wet-pack assembly of FIG. 2, taken along line 14-14 of FIG. 6, according to an exemplary embodiment.

In various embodiments, the wet-pack assembly 100 may include one or more features to prevent leakage of water from between components. The distribution tray 115 may include one or more air seals 345, which extend downward from wall 330 and surround (e.g., sandwich) an upper portion of the water panel 110. For example, as shown in FIG. 20*a*, the air seal 345 may be structured to extend downward and abut the water panel 110 on a first side 340 and a second side 342 (disposed opposite the first side 340) to create a seal against air bypass. In other embodiments, the air seal 345 may surround the entire upper portion of the water panel 110.

Additionally or alternatively, the distribution tray 115 may also be structured such that the ends 350 of the channels 155 extend into the water panel 110. For example, in some embodiments, the water panel 110 may include one or more recesses 355, which are each configured to receive an end 350 of a corresponding channel 155. Accordingly, water from the feed tube 120 that flows through the flow divider 147 to each of the channels 155 flows exclusively to an internal region of the water panel 110 and does not leak down a side of the water panel 110 or to a peripheral side of the scale control 105.

Figure 19B:
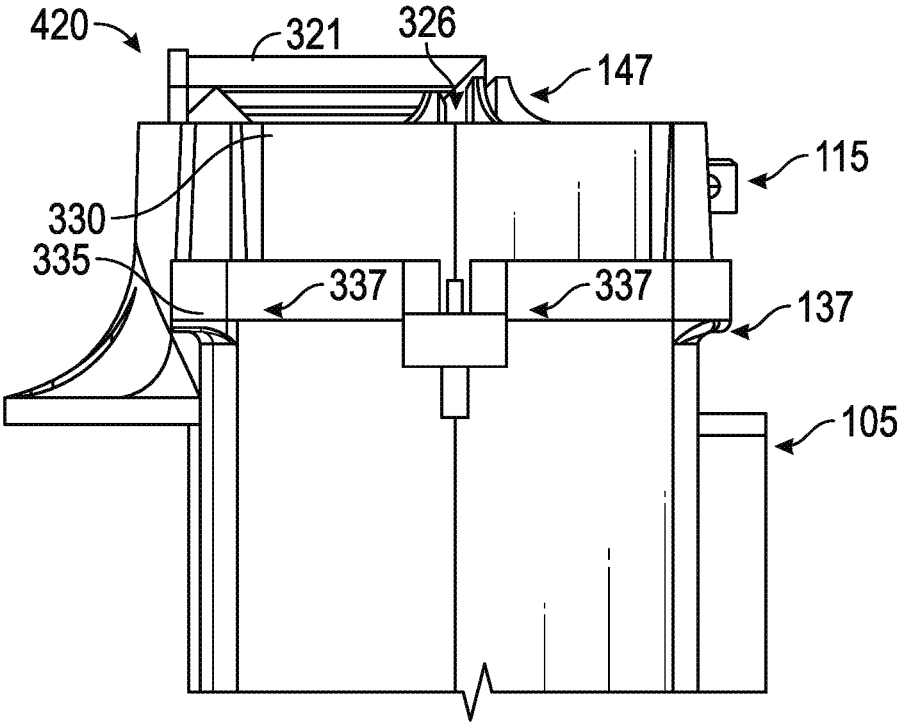
FIG. 19*b* is a side view of the wet-pack assembly of FIG. 4, according to another embodiment utilizing a two-piece feed tube configuration.
Figure 20B:
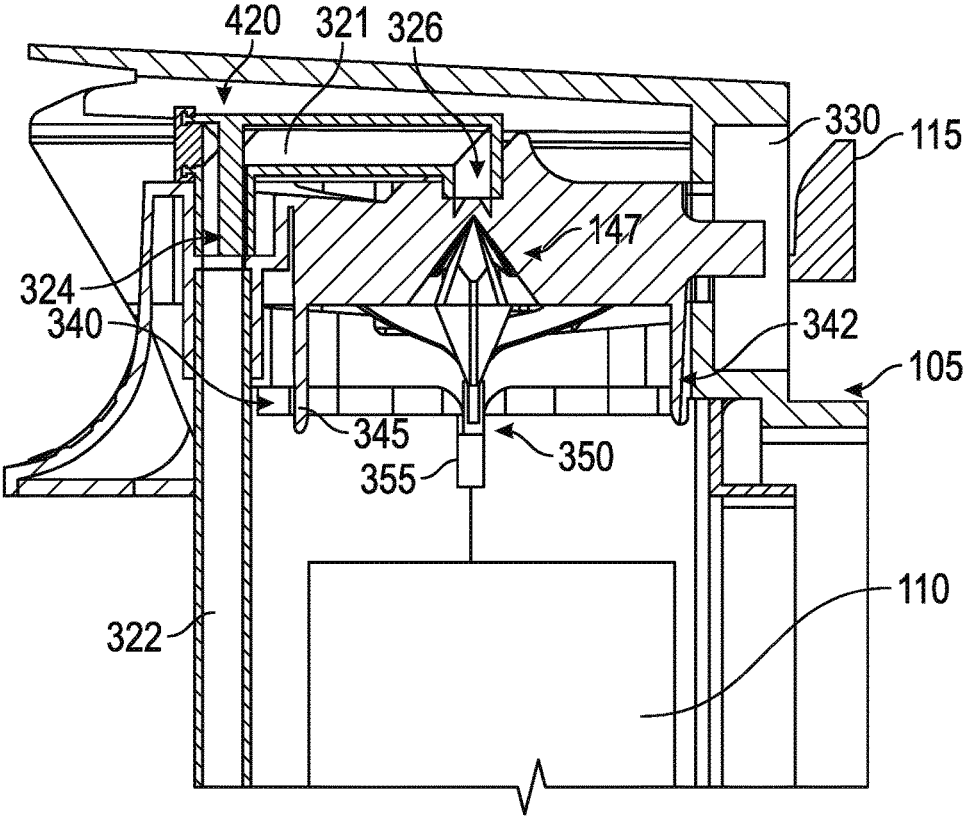
FIG. 20*b* is a side cross-sectional view of the wet-pack assembly of FIG. 4, taken along line 14-14 of FIG. 6, according to an embodiment utilizing a two-piece feed tube configuration.

FIGS. 19*b* and 20*b* depict similar views as in FIGS. 19*a* and 20*a* except that they depict embodiments using a feed tube 420 having a two-piece configuration similar to that depicted in FIG. 4 while FIGS. 19*a* and 20*a* depict embodiments having a feed tube 420 having a similar one-piece configuration to that depicted in FIGS. 2 and 3. Feed tube 420 includes a first feed tube portion 322 and a second feed tube portion 321. The first feed tube portion 322 is connected at one end to an eductor outlet in a similar manner as described above for feed tube 120 and is further connected to the second feed tube portion 321 at a first joint 324. The second feed tube portion 321 is further connected to the flow divider 147 via a second joint 326. The first and second joints 324, 326 are selectively separable such that the second feed tube portion 321 may be disconnected and remove from the assembly to enable selective removal and replacement of the wet-pack assembly. The first and second joints 324, 326 may include a separable snap connection, a collar connection configuration, a press-fit connection configuration or any other suitable secure and separable connection.

The first feed tube portion 322 may be integrally formed with the wet-pack assembly such that the first feed tube portion 322 does not need to be separately removed or disconnected from the wet-pack assembly upon replacement or servicing of the wet-pack assembly. Additionally, integrally forming the first feed tube portion 322 with the wet-pack assembly allows for a more secure and reliable connection between the eductor outlet and the first feed tube portion 322 that may be created at the time of manufacturing the wet-pack assembly.

Figure 21:
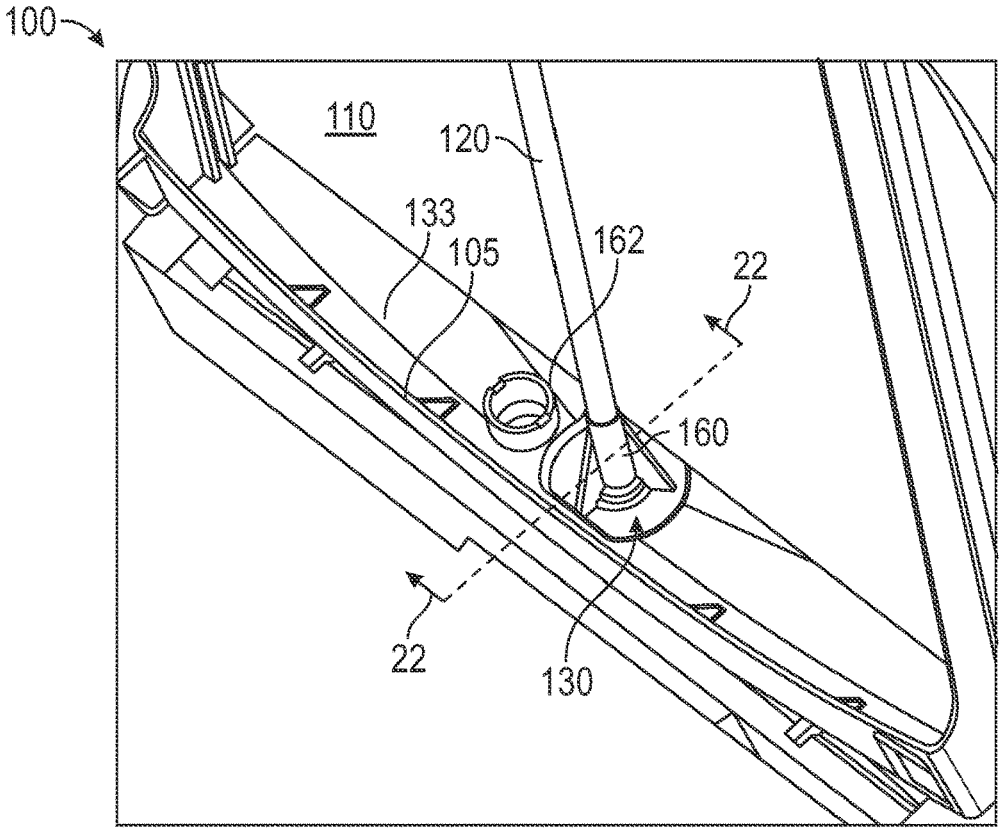
FIG. 21 is a top perspective view of the wet-pack assembly of FIG. 2 near an outlet within the scale control, according to an embodiment.
Figure 22:
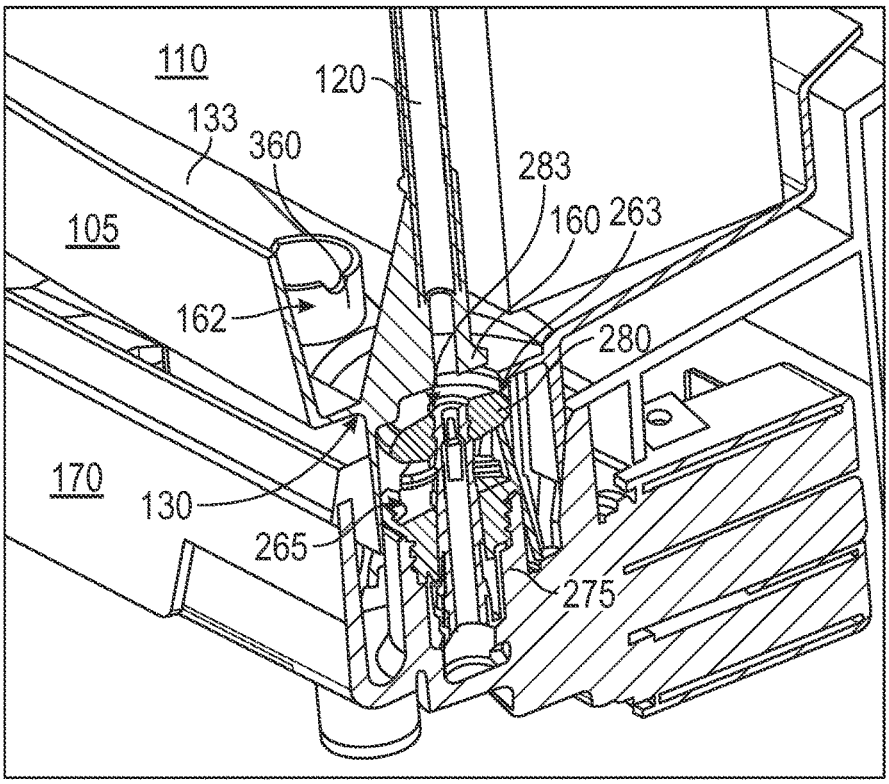
FIG. 22 is a side cross-sectional view of the wet-pack assembly of FIG. 21 taken along line 22-22.

In various embodiments, the wet-pack assembly 100 can be configured for operation with or without water recirculation. As described above, and as shown in FIGS. 21-22, the wet-pack assembly 100 may be structured such that the scale control 105 includes at least one drainage outlet to facilitate water flow away from the water panel 110. As shown, in some embodiments, the scale control 105 includes a first outlet, the eductor outlet 130 formed in the collar 160, which receives water from the basin 133 of the scale control 105. Water flowing to the eductor outlet 130 is then drawn into the feed tube 120 via the eductor 263 and recirculated to the water panel 110. As described above, in such embodiments, the check valve assembly 265 forms the eductor 263, which sends water through the orifice 283 through the feed tube 120 to draw water from the basin 133 into recirculation. The scale control 105 can also include a second outlet, such as the outlet 162 ("overflow outlet"), which facilitates water flow away from the water panel 110 if water within the basin 133 exceeds a threshold amount. In various embodiments, the threshold amount of water is determined based on a height of a rim or wall 360 surrounding the overflow outlet 162. Accordingly, if a water height reaches or exceeds the height of the overflow outlet 162, water then flows through the outlet 162 to drain the basin 133.

Figure 23:
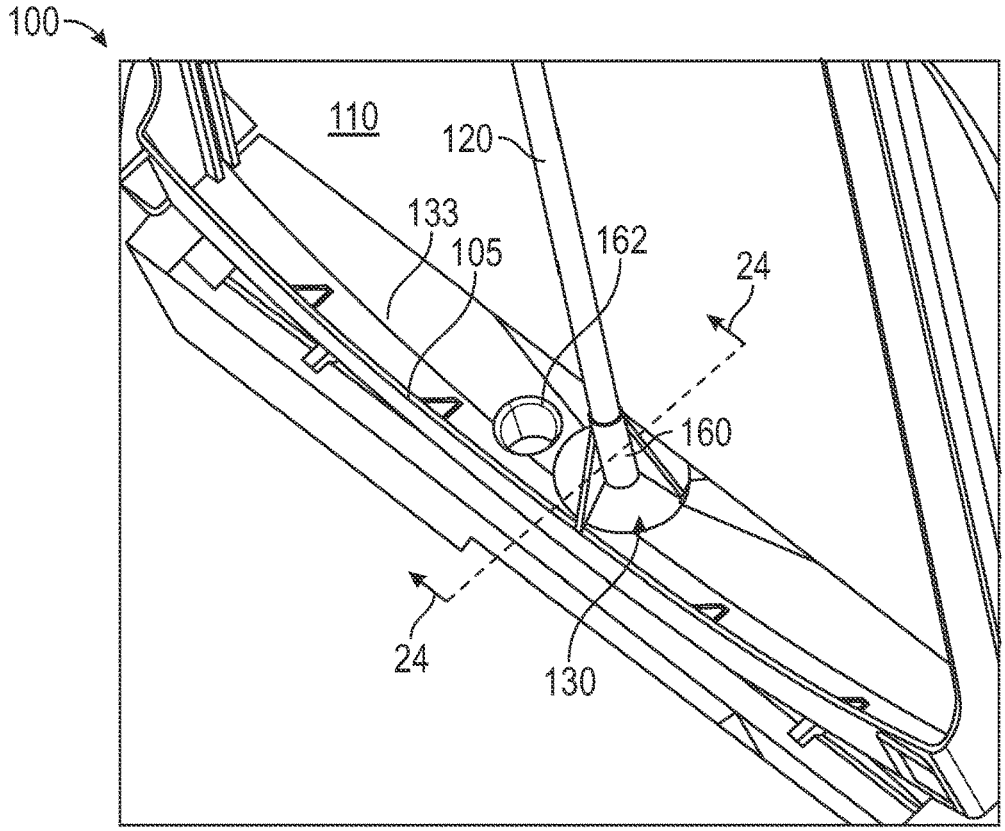
FIG. 23 is a top perspective view of the wet-pack assembly of FIG. 2 near an outlet within the scale control, according to another embodiment.
Figure 24:
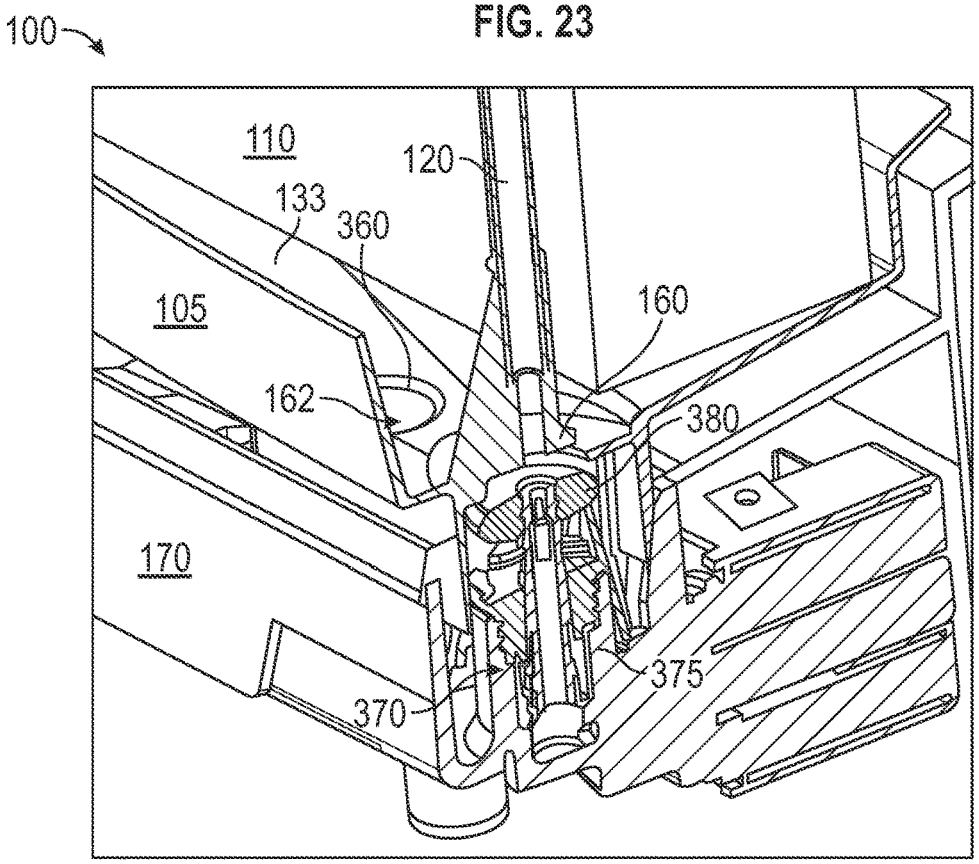
FIG. 24 is a side cross-sectional view of the wet-pack assembly of FIG. 23 taken along line 24-24.

In other embodiments, the wet-pack assembly 100 can be configured for operation without water recirculation, as shown in FIGS. 23-24. As shown in FIG. 23, in some embodiments, the collar 160 may be formed as a solid part having no outlets therein. Instead, all water flowing from the water panel 110 may be drained via the outlet 162. In such embodiments, the outlet 162 may be structured to have a wall 360 with minimal height (or the outlet 162 may have no wall 360) such that there is minimal water collected in the scale control 105. Accordingly, all water from the water panel 110 may be drained through the outlet 162 and not recirculated back to the water panel 110. In such embodiments, the wet-pack assembly 100 may include an alternate valve assembly 370 disposed within the collection member 170. As shown in FIG. 24, the valve assembly 370 may include a seal 380 (similar or equivalent to the seal 280), which is coupled to a stationary valve 375 having a fixed orifice adapter. Because the wet-pack assembly 100 can be structure to accommodate single-use water flow or recirculating water flow, the wet-pack assembly 100 can be configured for use in a variety of humidifying systems having either single-use or recirculating water flow.

Notwithstanding the embodiments described above in FIGS. 1-24, various modifications and inclusions to those embodiments are contemplated and considered within the scope of the present disclosure.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data, which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A wet-pack assembly comprising:
- a water panel;
- a scale control configured to surround at least a portion of the water panel;
- a distribution tray disposed on the water panel and coupled to the scale control via one or more joints, wherein the one or more joints prevent separation of the distribution tray from the scale control; and
- a feed tube extending from a basin formed within the scale control to the distribution tray, wherein the feed tube is structured to direct water flow to the distribution tray for distribution to the water panel.

2. The wet-pack assembly of claim 1, wherein the feed tube includes a first portion and a second portion, the first portion being coupled to an eductor outlet.

3. The wet-pack assembly of claim 2, wherein the second portion of the feed tube is coupled to a flow divider disposed within the distribution tray.

4. The wet-pack assembly of claim 2, wherein the first portion of the feed tube extends from the eductor outlet and through an aperture disposed within the distribution tray.

5. The wet-pack assembly of claim 1, wherein the distribution tray comprises a plurality of channels, wherein an end of each of the plurality of channels extends into the water panel.

6. The wet-pack assembly of claim 5, wherein the end of each of the plurality of channels extends into a corresponding recess disposed within the water panel.

7. The wet-pack assembly of claim 1, wherein the scale control comprises an upper portion, the upper portion being disposed adjacent the distribution tray and comprising a ridge, wherein a wall of the distribution tray is structured to be retained within the ridge.

8. The wet-pack assembly of claim 7, wherein the wall of the distribution tray is press-fit within the ridge.

9. The wet-pack assembly of claim 1, wherein the one or more joints comprises heat stakes.

10. The wet-pack assembly of claim 1, wherein the one or more joints comprises welds.

11. A humidifier comprising:
- a wet-pack assembly; and
- a collection member fluidly coupled to the wet-pack assembly;
- wherein the wet-pack assembly comprises:
  - a water panel;
  - a scale control configured to enclose the water panel;
  - a distribution tray disposed on a top portion of the water panel and coupled to the scale control, wherein the distribution tray is inseparable from the scale control; and
  - a feed tube extending from a basin formed within the scale control to the distribution tray, wherein the feed tube is structured to direct water flow to the distribution tray for distribution to the water panel.

12. The humidifier of claim 11, further comprising a base, wherein the wet-pack assembly is structured to be received within the base such that the distribution tray is configured to couple to a surface of the base.

13. The humidifier of claim 12, wherein a surface of the distribution tray comprises a snap feature, the snap feature being structured to be received within a slot disposed within the surface of the base.

14. The humidifier of claim 13, wherein the surface of the distribution tray further comprises a first protrusion and a second protrusion, wherein the snap feature is disposed between the first protrusion and the second protrusion.

15. The humidifier of claim 13, wherein the surface of the base further comprises a first placement feature and a second placement feature, wherein the slot is disposed between the first placement feature and the second placement feature, and wherein the first protrusion is configured to be received within the first placement feature and the second protrusion is configured to be received within the second placement feature.

16. The humidifier of claim 11, wherein the scale control is configured to mount to the collection member such that the scale control is selectively separable from the collection member.

17. The humidifier of claim 16, wherein a bottom side of the scale control comprises a dovetail protrusion, the dovetail protrusion being configured to be received within a pocket formed in a housing of the collection member to couple the collection member to the wet-pack assembly.

18. The humidifier of claim 17, wherein at least a portion of the dovetail protrusion comprises beveled edges.

19. The humidifier of claim 17, wherein the pocket comprises a first wall and a second wall, and wherein a thickness of at least one of the first wall or the second wall varies from a base of the pocket to an upper edge of the pocket.

20. The humidifier of claim 11, wherein the distribution tray comprises an air seal extending downward from an outer wall of the distribution tray, the air seal configured to surround an upper portion of the water panel.

* * * * *